United States Patent [19]

Cherian

[11] 4,391,510

[45] Jul. 5, 1983

[54] VOICE COIL ACTUATOR REGISTRATION SYSTEM

[75] Inventor: Abraham Cherian, Webster, N.Y.

[73] Assignee: Xerox Corporation, Stamford, Conn.

[21] Appl. No.: 173,572

[22] Filed: Jul. 30, 1980

[51] Int. Cl.[3] ..... G03G 15/14; G03G 21/00

[52] U.S. Cl. ..... 355/3 SH; 271/245; 271/246; 355/3 TR; 355/14 SH

[58] Field of Search ..... 355/3 R, 3 SH, 3 TR, 355/3 TE, 14 SH, 14 TR; 271/245, 246, 273, 274, 242, DIG. 3

[56] References Cited

U.S. PATENT DOCUMENTS

| | | | |
|---|---|---|---|
| 3,256,009 | 6/1966 | Reilly | 271/246 |
| 3,263,992 | 8/1966 | Schrempp | 271/246 |
| 3,637,203 | 1/1972 | French | 271/246 |
| 3,844,552 | 10/1974 | Bleau et al. | 271/246 X |
| 3,888,478 | 6/1975 | Alderman et al. | 271/245 X |
| 4,291,974 | 9/1981 | Silverberg | 355/76 |

FOREIGN PATENT DOCUMENTS

| | | | |
|---|---|---|---|
| 2017655 | 10/1979 | United Kingdom | 271/DIG. 3 |

OTHER PUBLICATIONS

A. Cherian; "A Paper Registration Mechanism"; Xerox Disclosure Journal; vol. 4, No. 4, Jul./Aug. 1979, p. 469.

*Primary Examiner*—Fred L. Braun

[57] ABSTRACT

A registration system for a copier includes dual magnetically actuated voice coils. The plungers of the coils serve as registration fingers which move into and out of the path of the substrate being registered to register and deskew the substrate.

4 Claims, 2 Drawing Figures

VOICE COIL ACTUATOR REGISTRATION SYSTEM

BACKGROUND OF THE INVENTION

This invention relates generally to an electrophotographic printing machine, and more particularly concerns a registration system for registering substrates along a predetermined path.

A typical electrophotographic printing machine utilized in the business office environment contains stacks of cut sheets of paper or other substrates on which copies of original documents are reproduced. Generally, these cut sheets of paper advance through the printing machine, one sheet at a time for suitable processing therein. Frequently, forwarding rollers are employed throughout the printing machine for moving the cut sheets of paper along a predetermined path. In many instances, it is necessary to have the cut sheet of paper wait prior to being advanced to the next processing station by the forwarding roller so as to be in synchronism with the various processing stations in the printing machine. This may be achieved by driving the sheets against a registration gate and de-energizing the forwarding rollers so that the copy sheet waits for a specified duration of time prior to continuing its advance. Various methods have been devised for deenergizing the forwarding rollers. For example, the forwarding rollers may be spaced from one another by the actuation of a solenoid. Alternatively, the forwarding rollers may be de-coupled from the drive motor through a clutch mechanism. Also, registration gates have been bulky and non-responsive to prompt movement required by high speed printers. All of these techniques require complex linkages, are slow in movement and require high power. In addition, they introduce added expenses in building and operating the printing machine. In addition, they are inadequate for high speed printing machines. As an improvement, this sytem over other registration systems takes positive control of the paper at the exact instance the timing sequence for synchronizing an image with a copy sheet is triggered. Existing systems have uncontrolled, unpredictable variable time periods between the starting of the timing sequence and positive paper control. To solve the problems, dual voice coil actuator assemblies are provided placed side by side and simultaneously actuated in order to avoid skew. Repeatability of finger movement in present systems is about ±10 milliseconds, however, the present invention provides repeatability of approximately ±1 millisecond.

SUMMARY OF THE INVENTION

Accordingly, in one aspect of the invention, a fast acting registration system is disclosed that is characterized by dual voice coil actuators located in the path of the cut sheets that registers and deskews the sheets. The plunger of the coils serves as the registration stop.

In another aspect of the invention, a registration system in a copier having a photoreceptor is disclosed that comprises a pair of normally spaced apart rollers. The rollers are magnetically attractable toward one another so that the rollers contact and advance sheets caught therebetween along a predetermined path. A feeder is provided for advancing sheets between the rollers when the rollers are spaced apart and into plungers protruding from dual voice coil actuators located in the predetermined path as registration stops for registering and deskewing the sheets. Afterwards, the rollers and the dual voice coil actuators are actuated simultaneously based upon the location of images on the photoreceptor so that the sheets are forwarded toward the photoreceptor in synchronism with images on the photoreceptor.

BRIEF DESCRIPTION OF THE DRAWINGS

Other objects and advantages of the present invention will become apparent upon reading the following detailed description and upon reference to the drawings, in which.

While the present invention will be described hereinafter in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
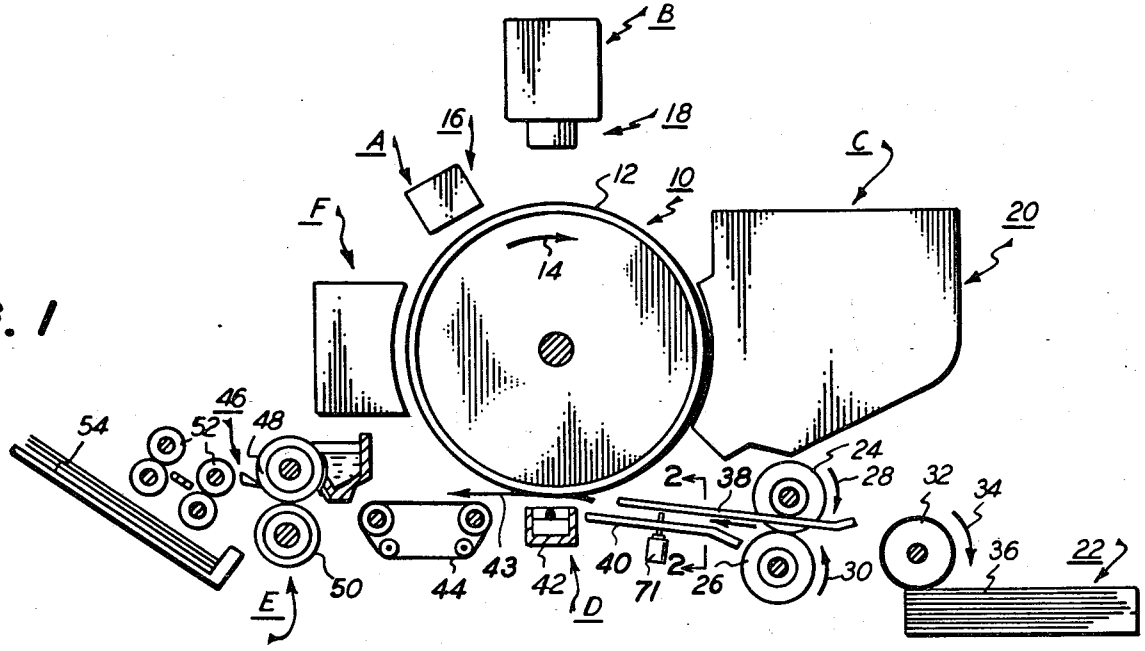
FIG. 1 is a schemtic elevational view of an electrophotographic printing machine incorporating the features of the present invention.

For a general understanding of an electrophotographic printing machine in which the features of the present invention may be incorporated, reference is made to FIG. 1 which depicts schematically the various components thereof. Hereinafter, like reference numerals will be employed throughout to designate identical elements. Although the apparatus for forwarding sheets along a predetermined path is particularly well adapted for use in the electrophotographic printing machine of FIG. 1, it should become evident from the following discussion that it is equally well suited for use in a wide variety of devices and is not necessarily limited in its application to the particular embodiment shown herein. For example, the apparatus of the present invention will be described hereinafter with reference to registering successive copy sheets, however, one skilled in the art, will appreciate that it may also be employed for registering successive original documents.

Since the practice of electrophotographic printing is well known in the art, the various processing stations for producing a copy of an original document are represented in FIG. 1 schematically. Each processing station will be briefly described hereinafter.

As in all electrophotographic printing machines of the type illustrated, a drum 10 having a photoconductive surface 12 entrained about and secured to the exterior circumferential surface of a conductive substrate is rotated in the direction of arrow 14 through the various processing stations. By way of example, photoconductive surface 12 may be made from selenium of the type described in U.S. Pat. No. 2,970,906 issued to Bixby in 1961. A suitable conductive substrate is made from aluminum.

Initially, drum 10 rotates a portion of photoconductive surface 12 through charging station A. Charging station A employs a corona generating device, indicated generally by the reference numeral 16, to charge photoconductive surface 12 to a relatively high substantially uniform potential. A suitable corona generating device is described in U.S. Pat. No. 2,836,725 issued to Vyverberg in 1958.

Thereafter drum 10 rotates the charged portion of photoconductive surface 12 to expose station B. Exposure station B includes an exposure mechanism, indicated generally by the reference numeral 18, having a stationary, transparent platen, such as a glass plate or the like for supporting an original document thereon. Lamps illuminate the original document. Scanning of the original document is achieved by oscillating a mirror in a timed relationship with the movement of drum 10 or by translating the lamps and lens across the original document so as to create incremental light images which are projected through an apertured slit onto the charged portion of photoconductive surface 12. Irradiation of the charged portion of photoconductive surface 12 records an electrostatic latent image corresponding to the informational areas contained within the original document.

Drum 10 rotates the electrostatic latent image recorded on photoconductive surface 12 to development station C. Development station C includes a developer unit, indicated generally by the reference numeral 20, having a housing with a supply of developer mix contained therein. The developer mix comprises carrier granules with toner particles adhering triboelectrically thereto. Preferably, the carrier granules are formed from a magnetic material with the toner particles being made from a heat settable plastic. Developer unit 20 is preferably a magnetic brush development system. A system of this type moves the developer mix through a directional flux field to form a brush thereof. The electrostatic latent image recorded on photoconductive surface 12 is developed by bringing the brush of developer mix into contact therewith. In this manner, the toner particles are attracted electrostatically from the carrier granules to the latent image forming a toner powder image on photoconductive surface 12.

With continued reference to FIG. 1, a copy sheet is advanced by sheet feeding apparatus 22 to transfer station D. Sheet feeding apparatus 22 advances successive copy sheets to forwarding rollers 24 and 26. Forwarding roller 24 is driven by a motor (not shown) in the direction of arrow 28 and roller 26 rotates in the direction of arrow 30 when roller 24 is in contact therewith. In operation, feed roller 32 rotates in the direction of arrow 34 to advance the uppermost sheet from stack 36. At this time, rollers 24 and 26 are spaced from one another. This defines a gap through which the leading edge of the sheet moves. After the leading edge of the sheet is registered, rollers 24 and 26 move into contact with the sheet so as to advance the sheet in the direction of arrow 43. The sheet is advanced through a chute formed by guides 38 and 40 to transfer station D. The detailed structure of forwarding rollers 24 and 26 is described in commonly assigned pending U.S. application Ser. No. 890,176, filed Mar. 27, 1978, now abandoned, in the name of Abraham Cherian. However, in general, the rollers move into and out of contact with the sheet depending upon whether they are waiting for a sheet to be advanced into the gap therebetween and registered or if the sheet is being advanced thereby. Thus, when the rollers are waiting for a sheet to be advanced thereto, they are spaced from one another defining a gap for receiving the sheets. Contrawise, when the rollers are advancing a sheet, they are moved into contact with the sheet so as to advance it.

Continuing now with the various processing stations, transfer station D includes a corona generating device 42 which applies a spray of ions to the back side of the copy sheet. This attracts the toner powder image from photoconductive surface 12 to the copy sheet.

After transfer of the toner powder image to the copy sheet, the sheet is advanced by endless belt conveyor 44, in the direction of arrow 43, to fusing station E.

Fusing station E includes a fuser assembly indicated generally by the reference numeral 46. Fuser assembly 46 includes a fuser roll 48 and a backup roll 50 defining a nip therebetween through which the copy sheet passes. After the fusing process is completed, the copy sheet is advanced by rollers 52, which may be of the same type as forwarding rollers 24 and 26, to catch tray 54.

Invariably, after the copy sheet is separated from photoconductive surface 12, some residual toner particles remain adhering thereto. These toner particles are removed from photoconductive surface 12 at cleaning station F. Cleaning station F includes a corona generating device (not shown) adapted to neutralize the remaining electrostatic charge on photoconductive surface 12 and that of the residual toner particles. The neutralized toner particles are then cleaned from photoconductive surface 12 by a rotatably mounted fibrous brush (not shown) in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine. Referring now to the specific subject matter of the present invention, FIG. 2 depicts the registration system in greater detail.

Figure 2:
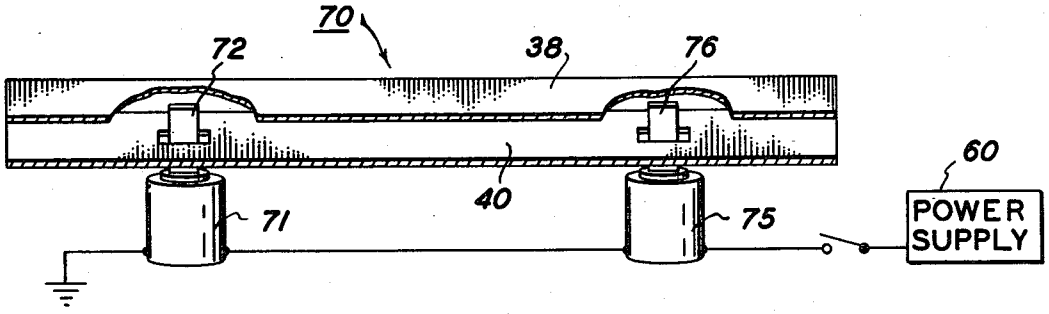
FIG. 2 is an end view of the registration system of the present invention taken along lines 2—2 of FIG. 1.

Referring now to FIG. 2, the detailed structure and operation of the present registration system 70 will be described. Sheets 36 are forwarded by separation roller 32 into a nip formed between magnetically actuated rollers 24 and 26 and into registration fingers 72 and 76 where the sheet is deskewed and registered. Rollers 24 and 26 are now deactuated to remove any driving force against sheet 36. When an image on photoreceptor 12 is synchronized with the location of sheet 36 at registration fingers 72 and 76, voice coils 71 and 75 are simultaneously actuated by power supply 60 to remove the plungers or fingers 72 and 76 from the path of the sheet. Also, at the same time, rollers 24 and 26 are moved into contact with the sheet, so as to advance the sheet with positive precise control in the direction of arrow 43. The sheet is advanced through a chute formed between guides 38 and 40 to transfer station D and receives the image from photoreceptor 12. The actuation of power source 60 and rollers 24 and 26 in response to the location of an image on the photoreceptor may be controlled by a suitable controller, such as the one disclosed in U.S. Pat. No. 4,183,089 which is incorporated herein by reference.

As an alternative, the sheets could be driven into the finger with a ball or belt transport instead of rollers 32. On a signal from the photoreceptor encoder, the pinch rollers would be actuated taking positive control of the paper and the voice coil would also be simultaneously actuated releasing the paper to meet the images on the photoreceptor. The pinch rolls could by synchronously driven with the drum as conventionally done.

Voice coils 71 and 75 are housed in containers with plungers 72 and 76 attached to a moving part of the coils. The plungers 72 and 76 are housed in bearings (not shown) and are free to slide up and down. When one polarity is applied, the plungers go to the end of their travel one way, when the polarity is reversed, the plungers return to their home position. In an alternative mode of operation, the plungers extend into the paper path when not actuated, and when current is applied the plunger retracts into the coil to allow the registered sheet to be forwarded. The stroke of the units is 0.1 inch. The units are made to specification by the Facet Corporation. Efficiency of the coils may be improved by adding magnetic fluid to the housings of the coils for damping purposes in the magnetic path.

The actuator unit works in principle similar to the loud speaker coil. A copper conductor is wound on a non-magnetic spool which is part of the actuator. The conductor is in a very permanent magnetic field and free to slide. When current is applied, the coil deflects. The low mass of the moving parts, high magnetic efficiency and high accuracy and repetition rate of the coils more than meet the requirements of quick response and long life registration means in high speed copiers.

In conclusion, according to the present invention, voice coil actuators are used as registration means in a high speed copier to register copy sheets with images on the photoreceptor of the copier. The voice coils are employed in pairs in the copy sheet path of the copier and are simultaneously actuated to release a sheet to be forwarded toward the photoreceptor. The plunger of the voice coils act as sheet stops and registers, as well as deskews, sheets forwarded thereagainst.

It is, therefore, evident that there has been provided in accordance with the present invention, a voice coil actuator registration system which fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. In a high speed copier having a photoreceptor, an imaging system for forming images of documents on said photoreceptor, a predetermined paper path, and a feeder for forwarding sheets from a source into said paper path, the improvement comprising:

a pair of normally spaced apart members;

means for attracting magnetically said members toward one another so that said pair of members contact and advance the sheets therebetween along the path with precise control of the sheets;

dual registration means adapted to stop the sheets forwarded by said feeder thereby registering and deskewing the sheets, said dual registration means including immediate response voice coil actuators with plungers of said actuators acting as registration stops, said members and said dual registration means being actuated simultaneously based upon the location of images on said photoreceptor, said members serving to positively drive the sheets past the now retracted plungers in synchronism with the images on said photoreceptor.

2. The improvement according to claim 1 wherein said voice coils are low mass units.

3. In a high speed copier having a photoreceptor, an imaging system for forming images of documents on said photoreceptor, a predetermined paper path, and a feeder for forwarding sheets from a source into said paper path, the improvement comprising:

dual registration means located within said paper path for registering and deskewing sheets forward by said feeder, said dual registration means includes immediate response low mass voice coil actuators, said voice coils having plungers therein which protrude into said paper path at rest to stop sheets forwarded by said feeder and out of said paper path when said voice coil is actuated in order to release the sheets for forwarding toward said photoreceptor is synchronism with images on said photoreceptor.

4. The improvement of claims 1 or 3 wherein said dual registration means have a repeatability of approximately $\pm 1$ millisecond.

* * * * *